US005425697A

United States Patent [19]

Lanvin

[11] Patent Number: 5,425,697

[45] Date of Patent: Jun. 20, 1995

[54] FOLDING DEVICE FOR PRODUCING FOLDED PRINTED PRODUCTS FROM A WEB OF PRINTED MATERIAL

[75] Inventor: Serge Lanvin, Cire Les mello, France

[73] Assignee: Heidelberger Druckmaschinen AG, Heidelberg, Germany

[21] Appl. No.: 79,715

[22] Filed: Jun. 18, 1993

[30] Foreign Application Priority Data

Jun. 25, 1992 [FR] France ..... 92 07807

[51] Int. Cl.[6] ..... B65H 45/16; B41F 13/60; B41F 13/62

[52] U.S. Cl. ..... 493/426; 493/430

[58] Field of Search ..... 493/1, 23, 358, 359, 493/360, 424, 425, 426, 427, 428, 429

[56] References Cited

U.S. PATENT DOCUMENTS 4,059,258 11/1977 Grantham ..... 493/29
5,004,451 4/1991 Prum ..... 493/359
5,072,919 12/1991 Schneider et al. ..... 493/426

FOREIGN PATENT DOCUMENTS 183567 10/1983 Japan ..... 493/430
2122975 1/1984 United Kingdom ..... 493/430

*Primary Examiner*—William E. Terrell
*Attorney, Agent, or Firm*—Kenyon & Kenyon

[57] ABSTRACT

A folding device is provided which produces folded printed products from an incoming web of printed material. The folding device has a mechanism for automatically converting the folding device from a configuration that forms a single transverse fold to a configuration that forms a second transverse fold parallel to the first fold. The conversion mechanism has a set of movable belts wound partially around a first folding cylinder and partially around a second folding cylinder. It also has a device for moving the set of movable belts to a first position, where the set of movable belts is wound partially around the first folding cylinder downstream of a plane P passing through the axes of the first and second folding cylinders, for forming a single transverse fold and to a second position, where the set of movable belts is wound only partially around the second folding cylinder downstream of the plane P passing through the axes of the first and second folding cylinders, for forming a second transverse fold parallel to the first fold.

8 Claims, 7 Drawing Sheets

FOLDING DEVICE FOR PRODUCING FOLDED PRINTED PRODUCTS FROM A WEB OF PRINTED MATERIAL

FIELD OF THE INVENTION

The present invention relates generally to a folding device for producing folded printed products from a web of printed material, and more particularly to a folding device for producing a first transverse fold, i.e., a fold perpendicular to the longitudinal edges of a printed product to be folded, and a second transverse fold parallel to the first transverse fold.

BACKGROUND OF THE INVENTION

In known folding devices which are used to produce folded printed products from a web of printed material (usually paper) the different folds are produced in the course of a series of successive exchanges between various cylinders, the axes of which are parallel.

First, the web of material is folded lengthwise by a folding device forming in the web a continuous fold parallel to the two edges of the web. Next, the folded web is cut transversely into printed products between a cutting cylinder having external cutting blades disposed along its generatrices and a transfer cylinder having on its outer surface rubber cutting counter parts which cooperate with the cutting blades. Impaling pins on the transfer cylinder penetrate the leading edge of the printed product thus cut in order to support it on the transfer cylinder for further processing.

The printed products then receive a first transverse fold between the transfer cylinder and a folding cylinder. In order to form this first fold, an engaging blade placed on the transfer cylinder acts at the middle of the printed product to be folded so as to insert this printed product into a folding jaw provided on the outer surface of the folding cylinder along a generatrix. If an additional fold must be made perpendicular to the first fold formed by the cylinders, and consequently parallel to the fold formed by the first folding device, the printed product already folded is transferred to a chopper fold device.

Sometimes, however, it is desired to make a second fold parallel to the first transverse fold. In this case, the above mentioned folding cylinder is provided with a second folding jaw disposed on its outer surface, along another generatrix offset from the first folding jaw by a circle arc of length equal to a quarter of the length of the printed product to be folded, so that the second jaw is disposed behind the first jaw with respect to the direction of rotation of the folding cylinder. A second cylinder parallel to the first folding cylinder interacts with the first folding cylinder to form a second transverse fold in the printed product. The second folding cylinder comprises a prehensile gripper which grips the dorsal part of the first transverse fold in the first folding jaw of the first folding cylinder and an engaging blade which produces the second transverse fold by inserting the printed product into the second jaw for forming a second fold which is supported by the first folding cylinder.

Sometimes a folding device of this latter type is used to form a printed product having a folded length equal to one third of the printed product's unfolded length. In this case, the relative positions of the various folding jaws and engaging blades are modified on the folding cylinders so as to occupy positions corresponding to one third and two thirds of the length of the printed product to be folded.

In order for known folding devices to alternate between a configuration for forming a single transverse fold and a configuration for forming two transverse folds, the second folding cylinder for forming the second transverse fold is mounted in journal bearings eccentric to the axis of the first folding cylinder, so that the second folding cylinder can be activated and deactivated.

In the configuration for producing a single transverse fold, the second cylinder is deactivated so that the center-to-center distance between the first folding cylinder and the second folding cylinder is increased so as to produce an uncoupling of this second folding cylinder with the first folding cylinder. As a result of this uncoupling, the second folding cylinder is immobilized so as to be held in a fixed position in which the grippers and the engaging blade of the second folding cylinder are inactive and do not interfere with the operation of the first folding cylinder. Furthermore, when the folding device is in this configuration, it is necessary to modify the release position of the printed product folded by the first folding jaw, by adjusting the eccentric cam controlling the opening of the first folding jaw on the first folding cylinder. The second folding jaw is opened and closed in continuous manner on the first folding cylinder but this movement performs no function because the engaging blade designed to insert the printed product into the second jaw does not operate.

When changing from the configuration of the folding device operating to produce a second transverse fold to the configuration operating to produce a single transverse fold, it is also necessary to secure onto the chassis on which the folding cylinders are mounted, a printed product guide between the immobilized second folding cylinder and the first folding cylinder. This guide prevents the end of the folded printed product from butting against the second folding cylinder and thus from being subjected to tearing or wrinkling.

As apparent from the above description, the modification of known folding devices from one folding configuration to another folding configuration is time consuming and necessarily must be carried out manually.

OBJECTS AND SUMMARY OF THE INVENTION

It is an object of the present invention to provide a folding device which can be automatically changed from one folding configuration to another both quickly and easily.

The present invention provides a folding device for producing folded printed products from an incoming web of printed material including a first folding cylinder having at least one first jaw for forming a first transverse fold in a printed product and at least one second jaw for forming a second transverse fold parallel to the first fold. The folding device further includes a second folding cylinder parallel to the first folding cylinder having at least one set of grippers and at least one engaging blade which cooperates with the first folding cylinder in forming the second transverse fold.

The folding device is provided with means for converting the folding device from a configuration that forms a single transverse fold to a configuration that forms a second transverse fold parallel to the first fold, wherein the conversion means connects the second folding cylinder to the first folding cylinder. The conversion means has a set of movable belts wound partially around the second folding cylinder, so that the second folding cylinder in rotation drives the set of movable belts. The folding device is also provided with means for moving the set of movable belts to a first position, where the set of movable belts is wound partially around the first folding cylinder downstream of a plane P passing through the axes of the first and second folding cylinders, for forming a single transverse fold and to a second position, where the set of movable belts is wound only partially around the second folding cylinder downstream of the plane P passing through the axes of the first and second folding cylinders, for forming a second transverse fold parallel to the first fold. The downstream side of the plane P is defined herein with respect to the directions of rotation of the folding cylinders which will be described later in the detailed description.

In the first position, the set of movable belts maintains the printed product on the first folding cylinder engaged in the first folding jaw as the first folding jaw delivers the printed product for further processing. In the second position, the set of grippers on the second folding cylinder grips the printed product engaged in the first folding jaw so as to maintain the printed product on the second folding cylinder until at least one engaging blade inserts the printed product into the second folding jaw of the first folding cylinder so as to form the second transverse fold in the printed product. Thus, according to the present invention, the second folding cylinder is mounted in rotation in continuous manner regardless of the configuration of the folding device, i.e., whether in the configuration for forming a single transverse fold or that for forming two parallel transverse folds. Moreover, the second folding cylinder is, regardless of the configuration, always coupled to the first folding cylinder.

An advantage of the folding device according to the present invention is that it can be easily automated. Another advantage of the folding device according to the present invention is that it eliminates the need for the removable guide disposed between the two folding cylinders for the execution of a single transverse fold. The removable guide is replaced by the set of movable belts which pass around the second folding cylinder and around movable pulleys disposed on a shaft. The shaft can easily be controlled so as to change the orientation of the belts during a conversion from one configuration of the folding machine to the other.

Other objects, characteristics and advantages of the present invention will become apparent in view of the detailed description along with the accompanying drawings that follow.

DETAILED DESCRIPTION

Figure 1:
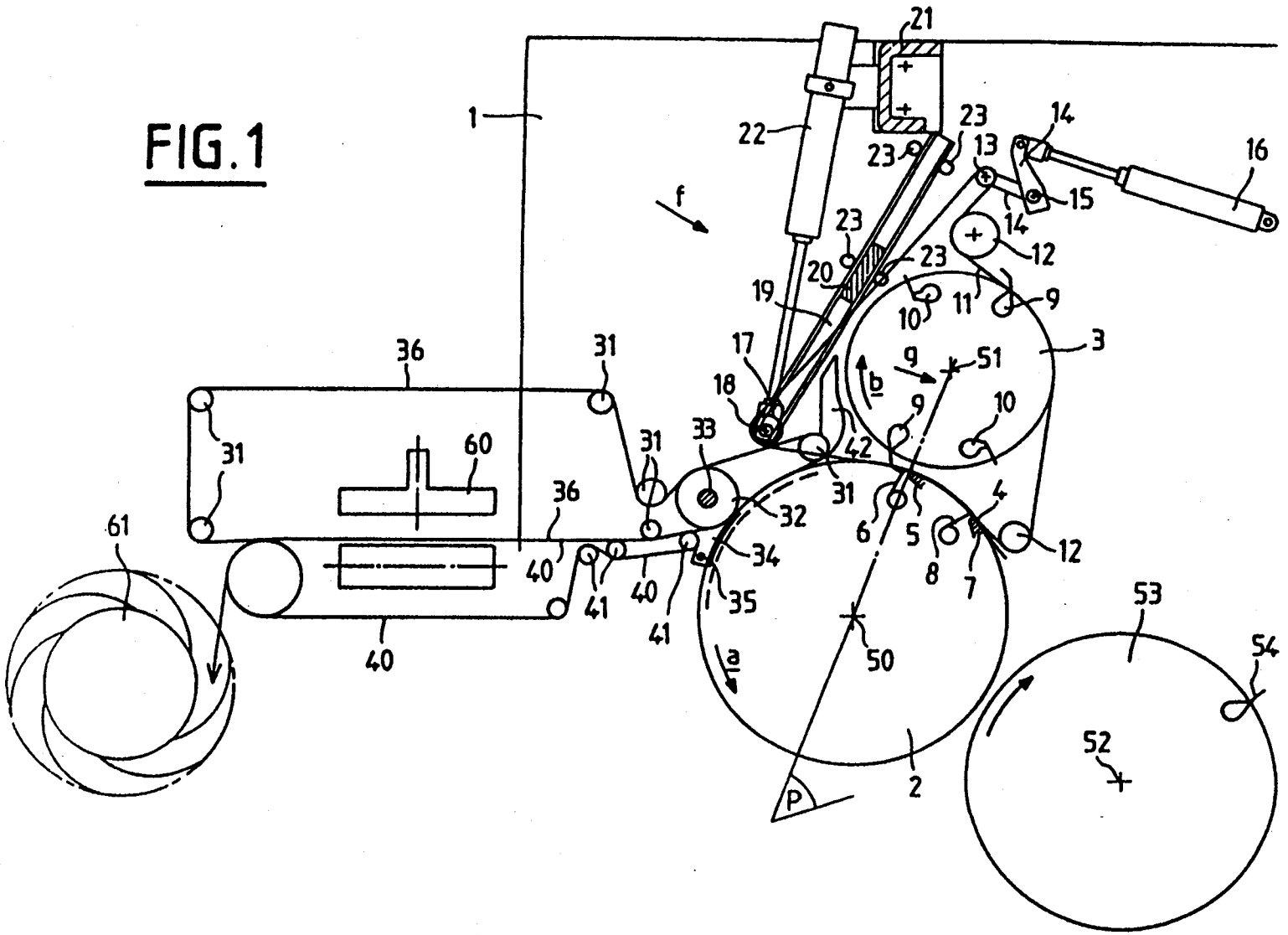
FIG. 1 is a partial elevation of one embodiment of the folding device according to the present invention in the configuration for forming a single transverse fold.

FIG. 1 shows a folding device for folding a printed product according to the present invention, adapted to operate in two configurations, one configuration serving to form a single transverse fold and a second configuration serving to form two parallel transverse folds. In FIG. 1, the folding device is shown in a configuration serving to form a single transverse fold in a printed product 4o The folding device comprises three cylinders driven in rotation, including a transfer cylinder 53 having an axis 52, a first folding cylinder 2 having an axis 50, and a second folding cylinder 3 for forming the second transverse fold having an axis 51. The three axes 50, 51, 52 of the three cylinders are parallel. The two folding cylinders 2, 3 turn in opposite directions, indicated respectively by arrows a and b, and the transfer cylinder 53 turns in the opposite direction to the first folding cylinder 2.

The first folding cylinder 2 comprises on its outer surface a first folding jaw defined by a fixed part 5 and a movable part 6 both extending along a generatrix of the folding cylinder. As shown in FIG. 1, the printed product 4 is retained by its dorsal part in the first folding jaw 5, 6. In addition, the first folding cylinder 2 comprises a second folding jaw defined by a fixed part 7 and a movable part 8 also extending along a generatrix of the folding cylinder. With respect to the direction of rotation of the folding cylinder 2 shown by arrow a, the second folding jaw 7, 8 is placed behind the first folding jaw 5, 6 at a distance which may be equal to a quarter of the format length of the printed product 4 to be folded.

The second folding cylinder 3 comprises at least two sets of prehensile grippers 9, and at least two engaging blades 10.

The movable parts of the folding jaws, prehensile grippers and engaging blades are all controlled by eccentric cams, cam rollers and levers (not shown) which are well known to those in the art and do not form a part of the present invention.

The folding device also comprises movable belts 11 which are partially wound around the second folding cylinder 3, as shown in FIG. 1. The second folding cylinder 3 drives the movable belts 11 in rotation. The movable belts 11 pass over deviation pulleys 12 and over tightening pulleys 13 mounted so as to be capable of pivoting with respect to a side frame 1 of the folding device on two levers 14, themselves mounted on a pivot 15. Alternatively, a spring producing the same force may be used in place of the levers 14. A pneumatic cylinder 16 supplied with compressed air at constant pressure serves to exert on the tightening pulleys 13 a constant force serving to tighten the movable belts 11.

The movable belts 11 also pass around several pulleys 17 rotatably mounted on a shaft 18. The shaft 18 is slideably mounted on two side frames 1, 1' of the folding device, as shown in FIG. 3, so as to be capable of occupying two positions, a first lower position shown in FIG. 1, and a second higher position shown in FIG. 2. These two positions will be described in detail below. More specifically, the shaft 18 is mounted on two sliding bars 19, 19' which are guided relative to the two side frames 1, 1', respectively, by a plurality of guiding rollers 23, 23'.

A cross-member 20 connects the two sliding bars 19 and 19'. In addition, a cross-member 21 connects the two side frames 1, 1'. A pneumatic jack 22, mounted on the cross-member 21, has a rod which is connected to the shaft 18 by a yoke.

When the pneumatic jack 22 is in an extended position, the shaft 18 is in the first lower position, as shown in FIG. 1. In this lower position, the set of movable belts 11 are wound partially around the first folding cylinder 2 covering part of its outer surface downstream of a plane P passing through the axes 50, 51 of the two folding cylinders 2, 3, with respect to the direction of rotation of the two folding cylinders.

Figure 2:
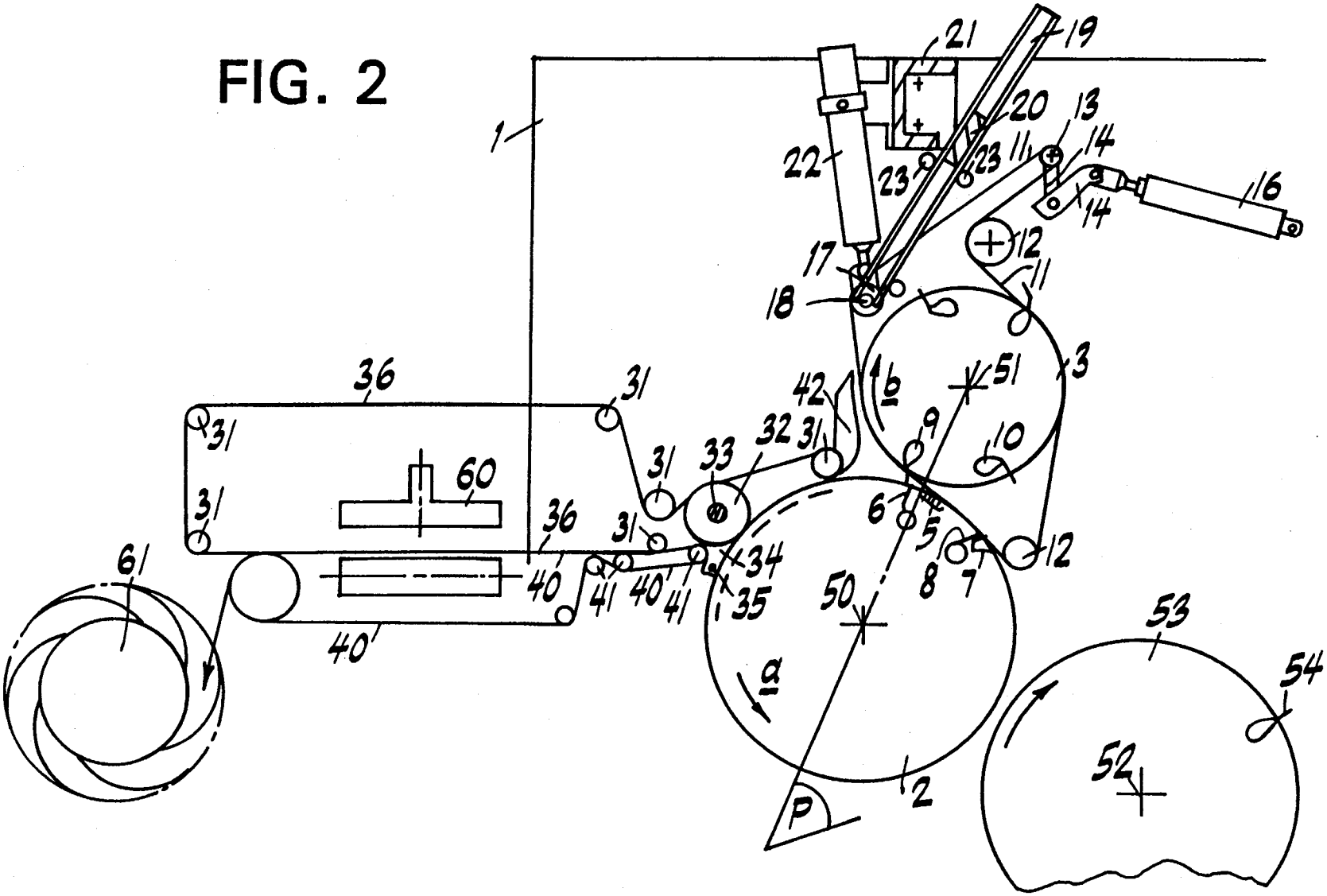
FIG. 2 is the same partial elevation of the folding device shown in FIG. 1 in the configuration for forming a parallel second transverse fold.
Figure 3:
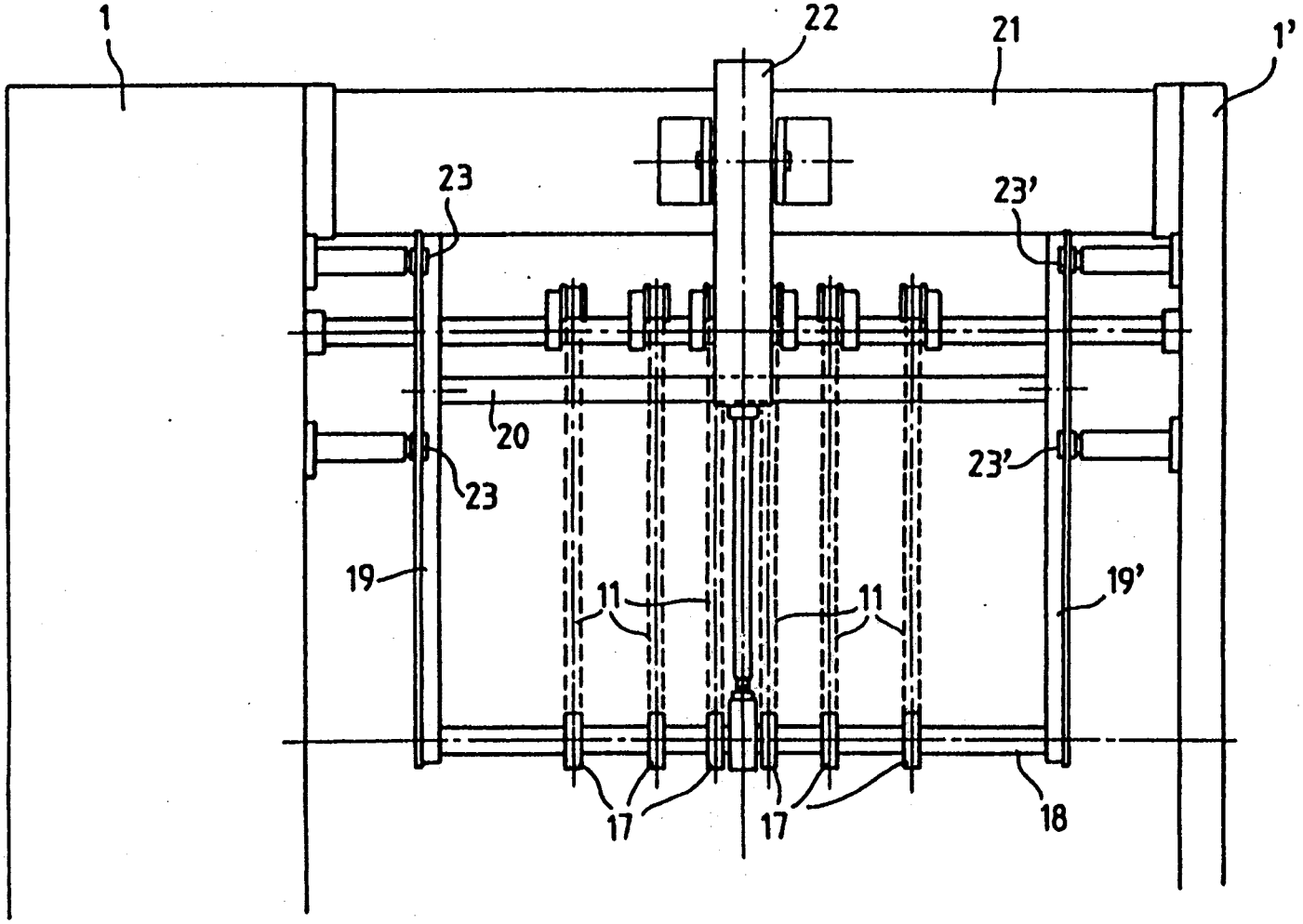
FIG. 3 is a side view in the direction of arrow f of the folding device shown in FIG. 1.

In contrast, when the pneumatic jack 22 is in a retracted position, as shown in FIG. 2, the shaft 18 is in the second higher position. In this position, the set of movable belts 11 are essentially wound partially around the second folding cylinder 3, downstream of the plane P passing through the axes 50, 51 of the two folding cylinders, while covering part of the surface of the first folding cylinder 2 upstream of the plane P, with respect to the defined directions of rotation of the two folding cylinders.

The folding device according to the present invention also comprises a set of endless belts 36 which are wound around pulleys 31 and pulleys 32 mounted on a shaft 33, as shown in FIGS. 1 and 2. The set of belts 36 transports the printed product 4 in the direction of an chopper fold device 60 or in the direction of a reception device 61. On their lower path between the pulleys 31 and 32, the belts 36 are wound partially around the outer surface of the second folding cylinder 2, so as to position the printed product 4 on the outer surface of the second folding cylinder 2. Stripping devices 34 are mounted on a bar 35 which connects the two side frames 1, 1' and is of circular cross-section. The stripping devices 34 project into circular grooves (not shown) formed in the first folding cylinder 2.

A guide 42 is also secured onto the chassis of the folding device in the zone where the second transverse fold is formed in the printed product 4, so as to prevent a tearing or a wrinkling of the printed products being folded.

Furthermore, a set of endless belts 40 is provided passing over pulleys 41 and disposed underneath the printed product 4. The set of endless belts 40 is applied against the set of belts 36 sandwiching the printed product 4 therebetween, so as to facilitate its transport as far as the chopper fold device 60 or the reception device 61.

Figure 4:
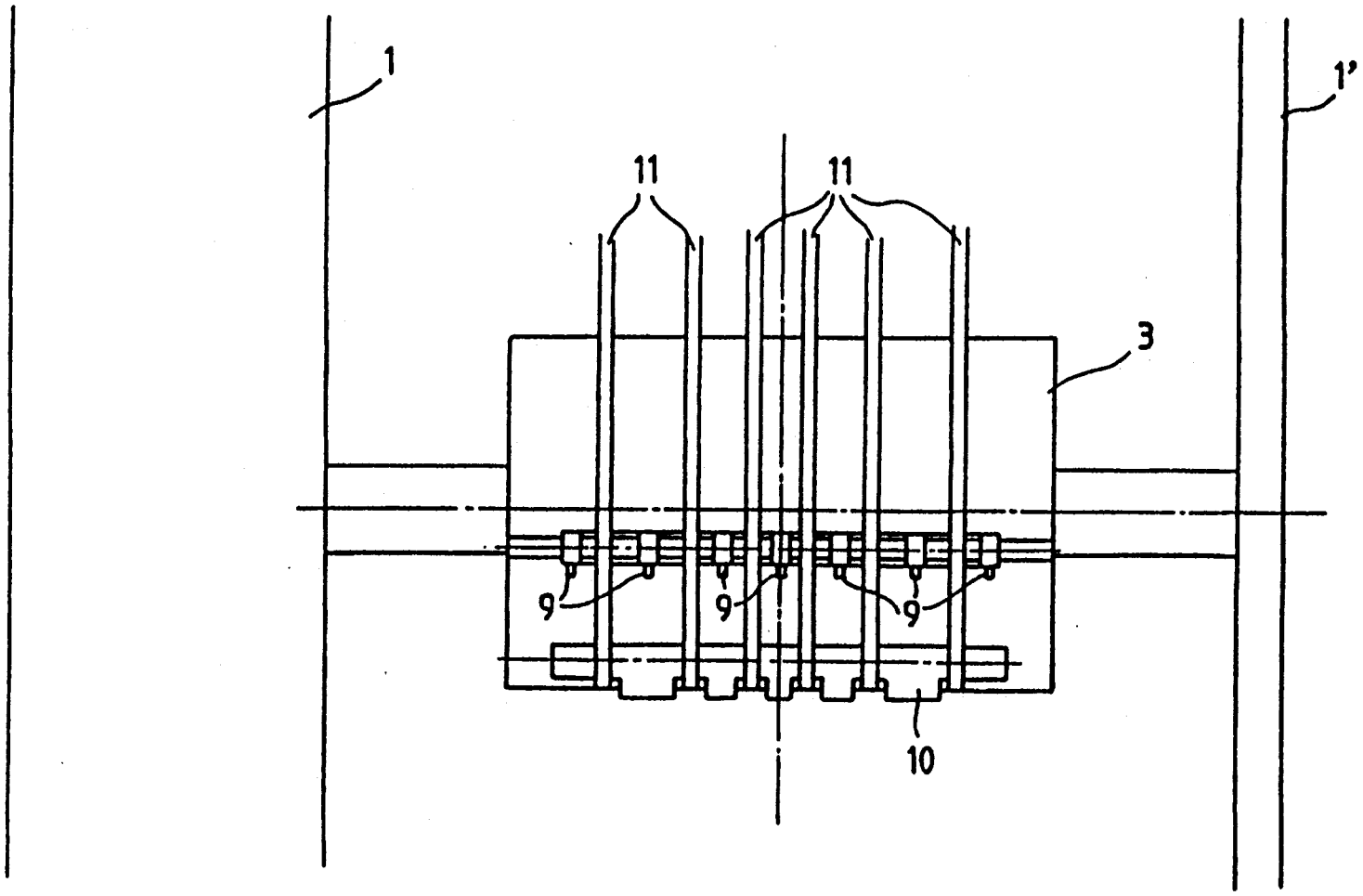
FIG. 4 is a side view in the direction of arrow g of the folding device shown in FIG. 1.

FIG. 4 shows the second folding cylinder 3 as well as all of the movable belts 11 wound around it. The movable belts 11 are disposed between adjacent prehensile grippers 9. In addition, the engaging blade 10, located behind the set of prehensile grippers 9, has a comb shape provided with grooves through which the movable belts 11 pass.

In order to form a single transverse fold in the printed product 4, the pneumatic jack 22 actuates the shaft 18 into the lower position, so that the movable belts 11 wind partially around the first folding cylinder 2, as shown in FIG. 1. The folding process according to the present invention then proceeds as follows:

The printed product 4 is inserted into the first folding jaw 5, 6 of the first folding cylinder 2 by an engaging blade 54 of the transfer cylinder 53 in the clearance between the two corresponding cylinders 2, 53, so as to form the transverse fold. The folding jaw 5, 6 is immediately closed and remains closed until it reaches the stripping devices 34 where it opens under the action of the eccentric cam (not shown) provided on the folding cylinder 2, so as to release the printed product 4 between the belts 36, 40 which transport the printed product in the direction of the chopper fold device 60 or in the direction of the reception device 61.

The set of movable belts 11 flatten the printed product 4 retained by the folding jaw 5, 6 onto the first folding cylinder 2 and maintain it on the first folding cylinder 2 on its path towards the chopper fold device 60 or the reception device 61. On the first folding cylinder 2, the folding jaw 7, 8 is closed and is opened once again without having any effect because the set of movable belts 11 flatten the folding printed product 4 onto the first folding cylinder 2, preventing the action of the engaging blade 10 of the second folding cylinder 3.

In fact, on the second folding cylinder 3, a set of prehensile grippers 9 is closed and an engaging blade 10 is activated without effect when they pass the plane P. Under the action of the set of movable belts 11, the printed product 4 remains rolled onto the first folding cylinder 2 and can be brought as far as the stripping devices 34 to be removed and inserted between the belts 36, 40.

In order to produce two parallel transverse folds one after the other, the pneumatic jack 22 actuates the shaft 18 into the second higher position, as shown in FIG. 2. The cam for driving the sets of prehensile grippers 9 of the second folding cylinder 3 is set so as to close a set of prehensile grippers 9 and to act upon the engaging blade 10 when passing the plane P. The process for producing the two transverse folds according to the present invention then proceeds as follows:

The printed product 4 is inserted into the jaw 5, 6 for forming the first fold by the engaging blade 54 of the transfer cylinder 53 when it passes in the clearance between the two cylinders 2, 53. The jaw 5, 6 is then immediately closed by its eccentric drive cam (not shown) just after having passed the clearance.

During the counter-clockwise rotation of the first folding cylinder 2 in the direction of the plane P passing through the axes 50, 51, the folding jaw 5, 6 is closed and opens only when passing the plane P as it passes through the clearance between the first folding cylinder 2 and the second folding cylinder 3. On the second folding cylinder 3, the set of prehensile grippers 9 closes precisely when passing the plane P, gripping the dorsal part of the printed product 4.

As the rotation continues, the two folding cylinders 2, 3 turn so that the engaging blade 10 protrudes from the second folding cylinder 3 and the second folding jaw 7, 8 is open on the first cylinder. When passing the plane P, the engaging blade 10 inserts the printed product 4 into the folding jaw 7, 8 which closes. Simultaneously, the set of prehensile grippers 9 opens so as to release the dorsal part of the printed product 4.

During the continuous rotation of the first cylinder 2 towards the stripping devices 34, the printed product 4 is then inserted into the folding jaw 7, 8 and slides on the guiding rail 42 so as to be provided with its second fold.

The folding jaw 7, 8 controlled through the intermediary of its eccentric cam (not shown) provided on the first folding cylinder 2 opens when it reaches the stripping devices 34 and the printed product 4 is then deflected and sandwiched between the two sets of belts 36, 40 in the direction of the reception device 61 or in the direction of the chopper fold device 60.

The description which has been given above allows for the transfer cylinder 53 and the first folding cylinder 2 to receive a triple paper format length and the second folding cylinder 3 to receive a double paper format length.

Figure 5:
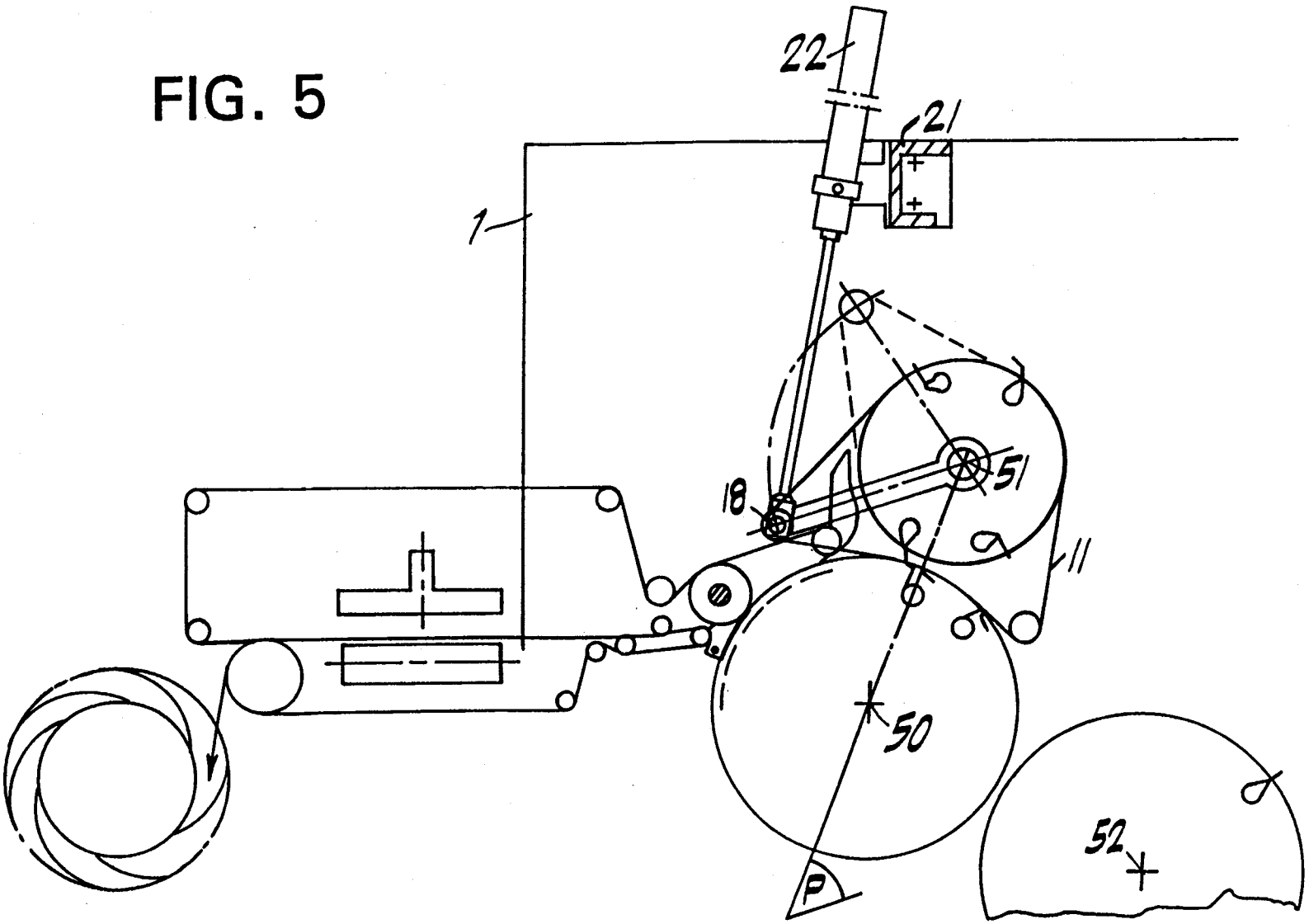
FIG. 5 is a partial elevation of another embodiment of the folding device according to the present invention in the configuration for forming a single transverse fold.

In another embodiment of the present invention, the shaft 18 fitted with the pulleys 17 described above as being slideably mounted between the two side frames 1, 1', may be mounted rotatably about the axis 51 of the second folding cylinder 3, so that it describes a portion of a circle centered on the axis 51 between the higher position and the lower position, as shown in FIG. 5. This has the advantage of eliminating the need for the belt tightening system 13, 14, 15, 16.

Figure 6:
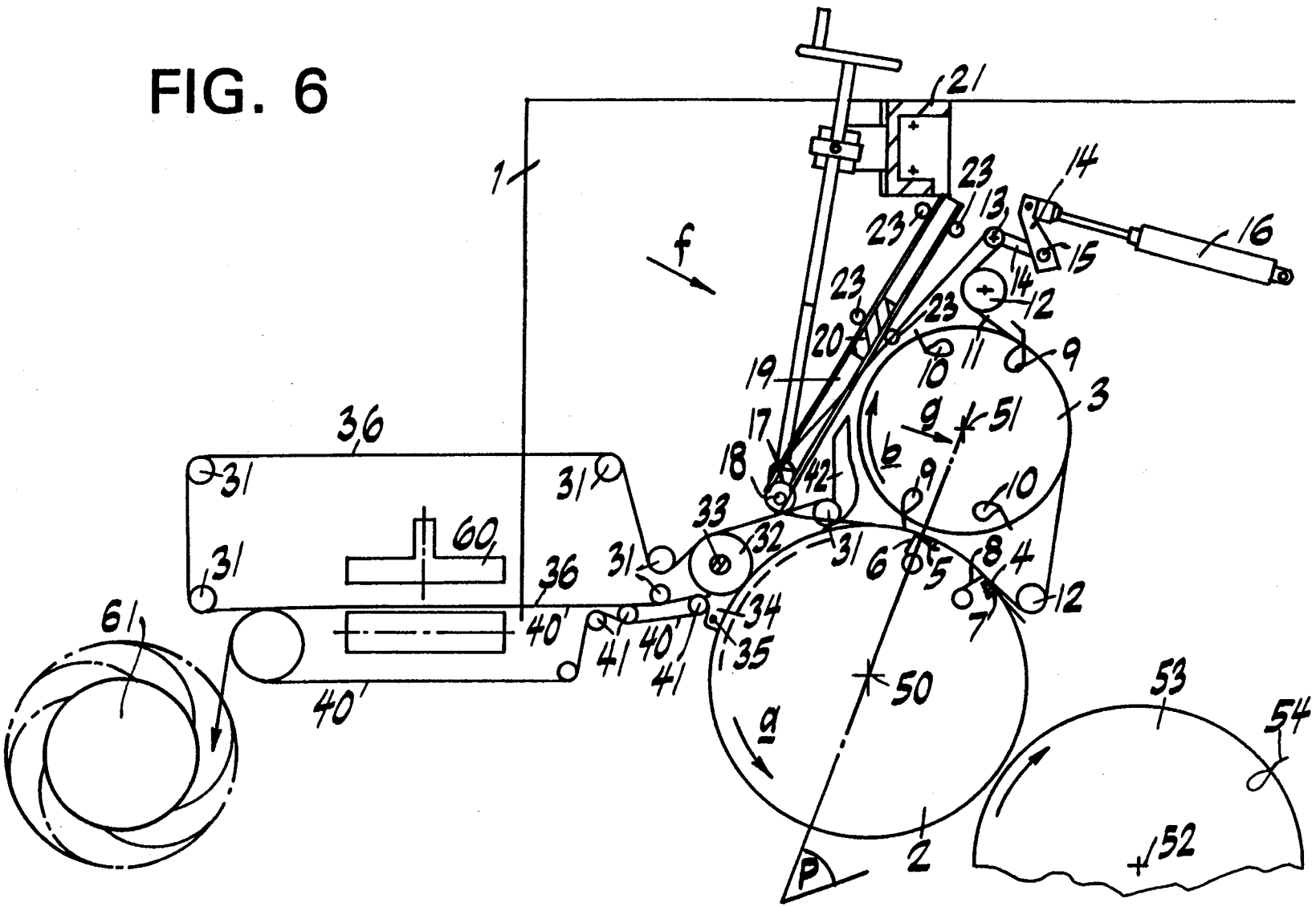
FIG. 6 is a partial elevation of a further embodiment of the folding device according to the present invention in the configuration for forming a single transverse fold.
Figure 7:
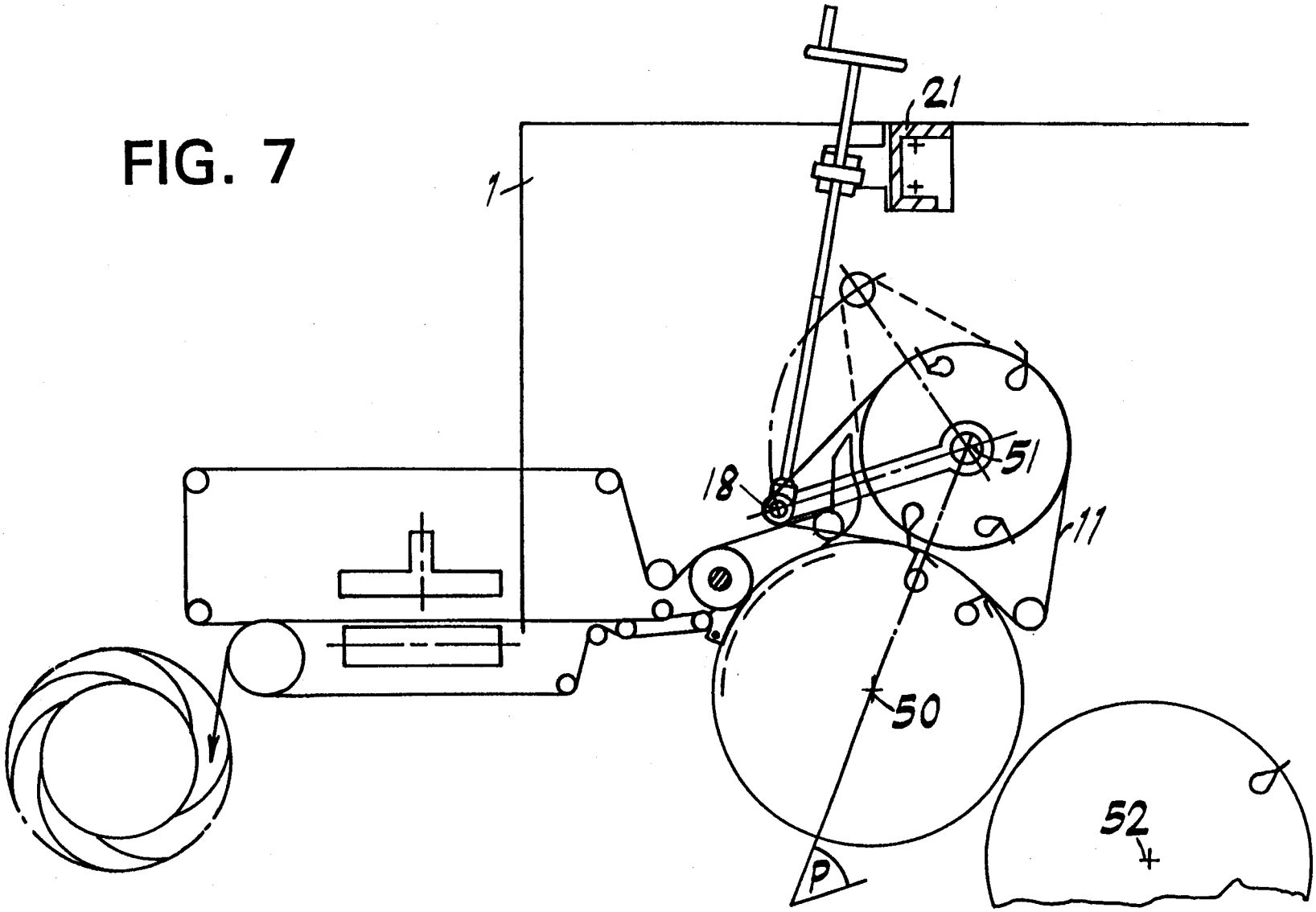
FIG. 7 is a partial elevation of still another embodiment of the folding device according to the present invention on the configuration for forming a single transverse fold.

In a further embodiment of the present invention, the pneumatic jack 22 actuating the shaft 18, either according to a rectilinear mode of movement, as shown in FIGS. 1 and 2, or according to a circular mode of movement, as shown in FIG. 5, may be replaced by an endless screw articulated on the cross-member 21 acting on a nut connected to the shaft 18 as shown in FIG. 6 and 7. A handwheel or remotely controlled motor could be used to rotate the endless screw.

Of course, the present invention is by no means limited to the embodiments described and shown. Rather, it is intended to encompass all modifications and variations falling within the spirit and scope of the invention as claimed.

I claim:

1. A folding device for producing folded printed products from an incoming web of printed material, comprising:

(a) a first folding cylinder having at least one first jaw for forming a first transverse fold in a printed product and at least one second jaw for forming a second transverse fold parallel to the first fold;

(b) a second folding cylinder parallel to the first folding cylinder having at least one set of grippers and at least one engaging blade which cooperates with the first folding cylinder in forming the second transverse fold; and (c) a set of movable belts wound partially around the second folding cylinder, so that the second folding cylinder in rotation drives the set of movable belts; and a drive for moving the set of movable belts to a first position, where the set of movable belts is wound partially around the first folding cylinder downstream of a plane P passing through the axes of the first and second folding cylinders, for forming a single transverse fold and to a second position, where the set of movable belts is wound only partially around the second folding cylinder downstream of the plane P passing through the axes of the first and second folding cylinders, for forming a second transverse fold parallel to the first fold, so that in the first position the set of movable belts maintains the printed product on the first folding cylinder engaged in the first folding jaw as the first folding jaw delivers the printed product for further processing and in the second position the set of grippers on the second folding cylinder grips the printed product engaged in the first folding jaw so as to maintain the printed product on the second folding cylinder until at least one engaging blade inserts the printed product into the second folding jaw of the first folding cylinder so as to form the second transverse fold in the printed product.

2. The folding device according to claim 1, further comprising a set of tightening pulleys mounted to a pneumatic jack wherein the set of movable belts passes around the tightening pulleys and the pneumatic jack exerts a constant pressure so as to tighten the set of movable belts.

3. The folding device according to claim 1, wherein the drive comprises a shaft having pulleys mounted thereon around which the set of movable belts pass.

4. The folding device according to claim 3, wherein the shaft is mounted between two side frames of the folding device so as to allow it to slide between the first position and the second position.

5. The folding device according to claim 4, wherein the drive further comprises a pneumatic jack mounted to the two side frames of the folding device which drives the shaft and is capable of occupying two positions, an extended position corresponding to the first position of the shaft and a retracted position corresponding to the second position of the shaft.

6. The folding device according to claim 4, wherein the drive further comprises an endless screw, articulated on a cross-member connecting the two side frames, which acts on a nut connected to the shaft between the first and second positions so as to drive the shaft, the endless screw in turn being driven in rotation either by a handwheel or by a remotely controlled motor.

7. The folding device according to claim 4, wherein the shaft is mounted on two sliding bars which are guided relative to the two side frames by a plurality of guiding rollers.

8. The folding device according to claim 3, wherein the shaft is mounted rotatably about the axis of the second folding cylinder, so that it describes a portion of a circle centered on the axis of the second folding cylinder between the first position and the second position.

* * * * *